United States Patent [19]

Schwanitz et al.

[11] Patent Number: 4,577,195

[45] Date of Patent: Mar. 18, 1986

[54] MINIATURIZED MOBILE RADIO RECEIVER WITH DIPOLE ANTENNA

[75] Inventors: Manfred Schwanitz; Dietrich Gaertner; Wolfgang Dressler, all of Berlin; Joerg Schenk, Pforzheim, all of Fed. Rep. of Germany

[73] Assignee: International Standard Electric Corporation, New York, N.Y.

[21] Appl. No.: 568,239

[22] PCT Filed: Apr. 16, 1984

[86] PCT No.: PCT/EP83/00106

§ 371 Date: Dec. 19, 1983

§ 102(e) Date: Dec. 19, 1983

[87] PCT Pub. No.: WO83/03716

PCT Pub. Date: Oct. 27, 1983

[30] Foreign Application Priority Data

Apr. 20, 1982 [DE] Fed. Rep. of Germany ..... 3214449

[51] Int. Cl.[4] ..... H01Q 1/24

[52] U.S. Cl. ..... 343/702; 455/270; 455/351

[58] Field of Search ..... 343/702, 802; 455/270, 455/271, 351

[56] References Cited

U.S. PATENT DOCUMENTS

| | | | |
|---|---|---|---|
| 3,918,062 | 11/1975 | Haruki et al. | 343/702 |
| 4,123,756 | 10/1978 | Nagata et al. | 343/702 |
| 4,313,119 | 1/1982 | Garay et al. | 343/702 |
| 4,491,843 | 1/1985 | Boubouleix | 343/702 |

*Primary Examiner*—Eli Lieberman

*Attorney, Agent, or Firm*—John T. O'Halloran; Jeffrey P. Morris

[57] ABSTRACT

The miniaturized mobile radio receiver has a straight dipole antenna whose wires run along the edge of the printed-circuit board(s) of the radio receiver and are connected at their outer ends to conductive areas. The conductive strips on the circuit board(s) which run parallel to the antenna constitute a resistive-capacitive shunt and are, therefore, open in the vicinity of the antenna base to block the flow of RF signals.

11 Claims, 5 Drawing Figures

MINIATURIZED MOBILE RADIO RECEIVER WITH DIPOLE ANTENNA

The present invention relates to a miniaturized mobile radio receiver and more particularly to a dipole antenna for such a receiver.

A miniaturized mobile radio receiver of this kind is disclosed in DE-GM 67 52 498. To form a straight dipole, the radio receiver described there includes two lines running within a housing formed by two plastic shells. The shells are held together at their narrow sides by two conductive caps which are connected as capacitive loads to the ends of the dipole wires.

Conductive strips of a printed-circuit board in the housing which run near the dipole wires strongly interact with the latter, and conductive strips extending from one half of the dipole to the other represent a resistive-capacitive shunt to the antenna. This increases the loss resistance and the equivalent capacitance of the antenna.

The object of the invention is to provide an improved miniaturized mobile radio receiver.

This object is attained by the means set forth in claim 1. Further advantageous aspects of the invention are apparent from the subclaims.

UK Patent Application 2 029 112 A discloses a television aerial consisting of a housing containing a preamplifier and a half-wave dipole whose elements are formed from strips of metal foil and carried on a cardboard or similar base. Connected to the base of the antenna is a coaxial cable running to the preamplifier. Besides the strips of metal foil, the board carries no conductive strips.

In the miniaturized radio receiver according to the invention, the decrease in the effective height and in the efficiency of the antenna due to the adjacent conductive strips is reduced to such a point that very high receiver sensitivity is achieved.

An embodiment of the invention will now be explained in more detail with reference to the accompanying drawings, in which.

Figure 1A:
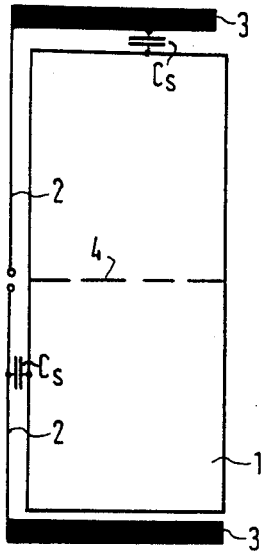
FIG. 1 is a highly simplified representation of the antenna and its equivalent circuit diagram.

FIG. 1*a* shows a printed-circuit board 1 of a miniaturized mobile radio receiver (not shown). Conductive strips and components have been omitted to simplify the illustration. Wires 2 running along the edge of the circuit board 1 form a straight dipole antenna. At the outer ends of the wires, capacitive loads are provided in the form of metallic areas 3. Between the wires and the areas on one side and the conductive strips of the circuit on the printed-circuit board 1 on the other side, capacitances $C_S$ are created (two of them are shown symbolically) whose value depends, inter alia, on the distance between the wires 2 and the conductive strips. If conductive strips extend from one half of the dipole to the other, the capacitances will act from one half of the dipole on the other.

Figure 1B:
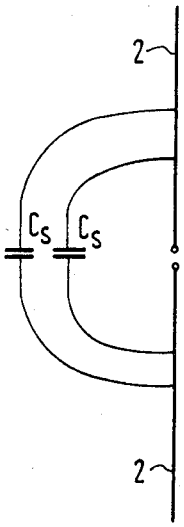

FIG. 1*b* shows the influence of the capacitances $C_S$ on the antenna. The capacitances $C_S$ act beyond the base region of the antenna and, thus, represent a resistive-capacitive shunt. This greatly increases the loss resistance and the equivalent capacitance of the antenna.

Figure 1C:
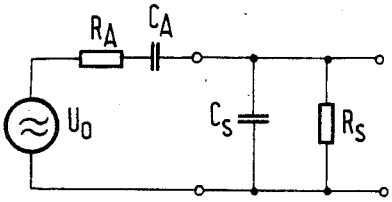

FIG. 1*c* shows the equivalent circuit diagram of the antenna. A generator with the open-circuit voltage $U_O$ is connected in series with a loss resistance $R_A$ and an antenna capacitance $C_A$. Connected across this series combination are the capacitances $C_S$, which have been combined into a single capacitance, and a resistance $R_S$. For the antenna load (not shown), this results in a capacitive voltage division which greatly reduces the output voltage of the antenna, and the resistive component $R_S$ causes a loss.

To avoid the resistive-capacitive shunt, all conductive strips of the printed-circuit board 1 are opened in the base region of the diple to block radio-frequency (RF) signals. This RF separation is indicated in FIG. 1*a* by the broken line 4. In conductive strips extending beyond the line 4 and interconnecting highly resistive sources and loads, resistors R of about 100K ohms are inserted at this point, and in conductive strips interconnecting low-resistance sources and loads, resonant circuits are inserted. The resistors must have low capacitance and inductance values.

Figure 2:
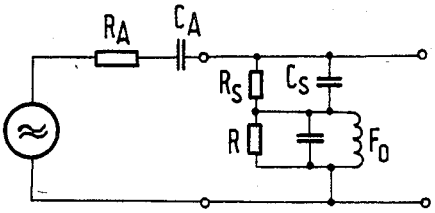
FIG. 2 is an equivalent circuit diagram of the antenna with conductive strips opened to block the flow of RF signals.

In the equivalent circuit diagram of FIG. 2, a large resistance R and a resonant circuit of frequency $F_O$ are present in the branch of the capacitance $C_S$ and the resistance $R_S$. Now, almost the full antenna voltage can reach the load (not shown). The frequency $F_O$ of the resonant circuit is chosen to be approximately equal to the frequency of the signal to be received.

To obtain only one resonant-circuit module, all resonant circuits in the low-resistance conductive strips extending beyond the line 4 may be combined. To do this, the wires of the resonant circuits are twisted together and wound on a coil form enclosed in a ferrite pot core. The number of turns is chosen so that the frequency $F_O$ is reached.

Figure 3:
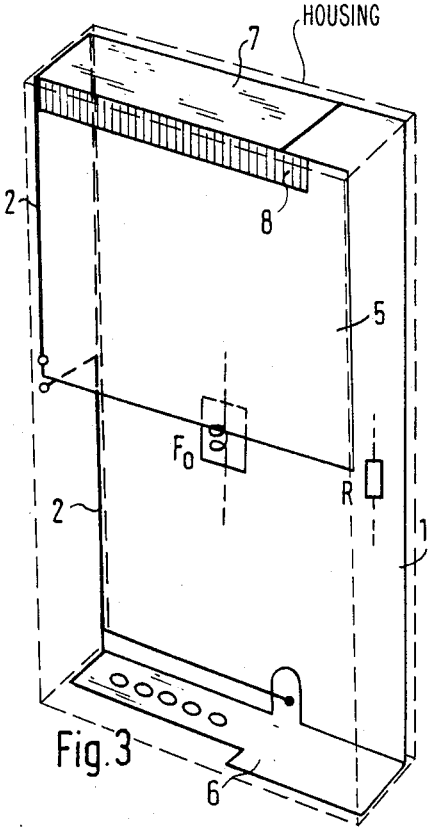
FIG. 3 is a perspective view of printed-circuit boards with an antenna.

In radio receivers with one printed-circuit board, the antenna wires 2 run along the long edge of the printed-circuit board 1. Some radio receivers have two printed-circuit boards 1 and 5, of which the printed circuit board 5, for example, is smaller than the board 1. FIG. 3 shows the printed-circuit boards 1 and 5 in a perspective view. The wire 2 of one half of the dipole runs along the edge of the printed-circuit board 1, and the wire 2 of the other half runs along the edge of the printed-circuit board 5. The base of the antenna may be located on either of the boards. In FIG. 3, it is located on the board 5. The lower edge of the printed-circuit board 1 has a metal sheet 6 attached to it which is connected to the wire 2 of the lower half of the dipole and, thus, acts as a capacitive load. Attached between the printed-circuit boards 1 and 5 at the upper edges thereof is a metal sheet 7 which is connected to a metallized area 8 on the printed-circuit board 5. Connected to the metal sheet 7 and the area 8 is the end of the wire 2 of the upper half of the dipole so as to create a capacitive load. Arrangements in which capacitive loads are created only with metal sheets or metallized areas or with a combination different from that shown are also possible.

In the area of the antenna base, which coincides with the lower edge of the printed-circuit board 5 in the example shown, all conductive strips on the printed-circuit board 1 which extend beyond this area have been opened to block the flow of RF signals. To this end, resistors R (only one resistor shown) of low capacitance and inductance have been inserted in the highly resistive conductive strips, and resonant circuits of frequency $F_O$ in the low-resistance conductive strips. The resonant circuits may all be enclosed in one pot core, as described above.

We claim:

1. In a miniaturized radio receiver with a housing, said receiver including at least one printed circuit board containing a plurality of components interconnected on said board by means of conductive strips, a dipole antenna having first and second wires directed parallel to one edge of said board with said first wire directed from the top of said edge towards the center of said board and said second wire directed from the bottom of said edge towards the center of said board to create a space between said wires near the center of said board to form a dipole antenna with said base of said antenna positioned near the center of said board, the combination therewith of capacitive loads for said wires comprising:

first and second conductive areas with said first area connected to said first wire at the top of said edge and positioned transverse to said first wire, with said second area connected to said second wire at the bottom of said edge and positioned transverse to said second wire, with each conductive area directed parallel to a corresponding side of said printed circuit board and spaced therefrom to create a predetermined capacitive value for each of said antenna wires, and means coupled to said conductive strips on said board to effectively open said conductive strips near said base of said dipole to block the flow of RF signals.

2. The combination according to claim 1, wherein said means includes a low capacitance and a low inductance resistor, inserted in each conductive strip running between highly resistive sources and loads.

3. The combination according to claim 1, wherein said means includes a resonant circuit inserted in each conductive strip running between low resistance sources and loads.

4. The combination according to claim 3, wherein each resonant circuit consists of a wire wound on a coil form.

5. The combination according to claim 2, wherein each resistor has a value of about 100K ohms.

6. The combination according to claim 3, wherein said resonant circuits are tuned to the frequency of reception of said radio receiver.

7. In a miniaturized radio receiver with a housing, said receiver including first and second printed circuit boards with said boards having equal length top and bottom edges and spaced apart in a parallel relation with said top and bottom edges aligned with, one of said boards being of a greater length than said other, with both of said boards supporting a plurality of components interconnected by conductive strips, a dipole antenna having first and second wires, with said first wire directed parallel to a side edge of said first board and said second wire directed parallel to a corresponding side edge of said second board to form said dipole antenna with the base of said dipole positioned near the bottom edge of said smaller board, the combination therewith of capacitive loads for said wires comprising:

first and second conductive areas with said first area connected to said first wire and directed transverse to the same and parallel to an edge of said first board, with said second conductive area connected to said second wire and directed parallel to an edge of said second board with said areas creating predetermined capacitive values for each of said wires and means coupled to said conductive strips on said boards to effectively open said conductive strips in the vicinity of said antenna base to block the flow of RF signals.

8. The combination according to claim 7, further including a third conductive area located between the space between said first and second boards and connected to said conductive area associated with said second smaller board, both areas connected with the end of said second wire.

9. The combination according to claim 7, wherein said means to open said conductive strips includes a low capacitance, low inductance resistor inserted in each conductive strip running between highly resistive sources and loads.

10. The combination according to claim 7, wherein said means to open said conductive strip includes a low capacitance, low inductance resistor inserted in each conductive strip running between low resistive sources and loads.

11. A dipole antenna structure for a miniaturized radio received or the like, said receiver of the type having at least one printed circuit board for containing a plurality of components interconnected on said board by means of conductive strips, said board being generally of a rectangular configuration having parallel top and bottom surfaces interconnected by parallel side surfaces, comprising:

a first wire directed along a side edge from a top surface towards the center and a second wire directed along said side edge from said bottom surface towards said center, with each wire spaced from said edge at the same distance and directed relatively parallel thereto, with said wires forming a dipole with the base of said dipole positioned near the center of said board and first and second conductive areas each directed parallel to and spaced from an associated top and bottom edge, with the end of said first wire connected to said first area at said top surface and with the end of said second wire connected to said second area at said bottom surface, with said conductive areas creating a predetermined capacitive value for each of said wires and means coupled to said conductive strips on said board to effectively open said conductive strips at the vicinity of said dipole base to block the flow of RF signals.

* * * * *